US005635459A

United States Patent [19]

Stoffa et al.

[11] Patent Number: 5,635,459

[45] Date of Patent: Jun. 3, 1997

[54] BORATED OVERBASED SULFONATES FOR IMPROVED GEAR PERFORMANCE IN FUNCTIONAL FLUIDS

[75] Inventors: John V. Stoffa, North Olmsted; Richard E. Gapinski, Mentor, both of Ohio

[73] Assignee: The Lubrizol Corporation, Wickliffe, Ohio

[21] Appl. No.: 549,289

[22] Filed: Oct. 27, 1995

[51] Int. Cl.[6] ..... C10M 141/02; C10M 141/12

[52] U.S. Cl. ..... 508/186; 508/371

[58] Field of Search ..... 508/185, 186, 508/371

[56] References Cited

U.S. PATENT DOCUMENTS

| | | | |
|---|---|---|---|
| 3,480,548 | 11/1969 | Hellmuth et al. | 252/33.4 |
| 3,929,650 | 12/1975 | King et al. | 252/33.4 |
| 3,933,659 | 1/1976 | Lyle et al. | 252/32.7 |
| 3,953,347 | 4/1976 | Habiby | 252/48.6 |
| 4,116,877 | 9/1978 | Outten et al. | 252/72 |
| 4,410,438 | 10/1983 | Horodysky | 252/49.6 |
| 4,744,920 | 5/1988 | Fischer et al. | 508/186 |
| 4,792,410 | 12/1988 | Schwind et al. | 252/38 |
| 5,062,975 | 11/1991 | Bayles Jr. et al. | 252/33 |
| 5,284,591 | 2/1994 | Bayles Jr. et al. | 252/33 |
| 5,403,501 | 4/1995 | Schwind | 508/186 |

FOREIGN PATENT DOCUMENTS

| | | | |
|---|---|---|---|
| 0113199 | 7/1984 | European Pat. Off. | C10M 1/46 |
| 1440261 | 6/1976 | United Kingdom | C10M 1/24 |
| 1452513 | 10/1976 | United Kingdom | C10M 1/36 |

*Primary Examiner*—Jacqueline V. Howard

*Attorney, Agent, or Firm*—William J. Connors; Frederick D. Hunter

[57] ABSTRACT

A functional fluid composition having improved gear performance comprises an oil of lubricating viscosity, and added thereto (a) an alkali or alkaline earth metal salt complex in the form of borated and/or non-borated salts;

(b) an EP/antiwear agent comprising a mixture of zinc salts of dialkylphosphorodithioic acid and 2-ethylhexanoic acid heated with triphenyl phosphite or an olefin; and (c) a borated epoxide.

The oil of lubricating viscosity has a kinematic viscosity of at least 4 cSt and 100° C. and a −40° C. Brookfield viscosity of less than 20,000.

28 Claims, No Drawings

BORATED OVERBASED SULFONATES FOR IMPROVED GEAR PERFORMANCE IN FUNCTIONAL FLUIDS

BACKGROUND OF THE INVENTION

A functional fluid is a term which encompasses a variety of fluids including but not limited to tractor fluids, automatic transmission fluids, manual transmission fluids, hydraulic fluids, power steering fluids, fluids related to power train components and fluids which have the ability to act in various different capacities. It should be noted that within each of these fluids such as, for example, automatic transmission fluids, there are a variety of different types of fluids due to the various transmissions having different designs which have led to the need for fluids of markedly different functional characteristics. One type of functional fluid is generally known as a tractor fluid which can be used in connection with various types of tractor equipment in order to provide for the operation of the transmission, gears, bearings, hydraulics, power steering, mechanical power take-off and oil immersed brakes of the tractor.

The components included within a functional fluid such as a tractor fluid must be carefully chosen so that the final resulting fluid composition will provide all the necessary characteristics required and pass a variety of different types of tests. In general, a tractor fluid must act as a lubricant, a power transfer means and a heat transfer means.

Tractor fluids have a number of important specific characteristics which provide for their ability to operate within tractor equipment. Such characteristics include the ability to provide proper frictional properties for preventing wet brake chatter of oil-immersed brakes while simultaneously providing the ability to actuate wet brakes and provide power take-off (PTO) clutch performance. A tractor fluid must provide sufficient antiwear and extreme pressure properties as well as water tolerance/filterability capabilities.

As manufacturers set new standards for functional fluids, especially in demanding high performance for wear and extreme pressure properties while at the same time using thinner oil for improved low temperature performance, new challenges are put in fluid formulations.

The extreme pressure (EP) properties of tractor fluids are demonstrated by the ability of the fluid to pass a spiral bevel test as well as a straight spur gear test. The tractor fluid must pass wet brake chatter tests as well as provide adequate wet brake capacity when used in oil-immersed disk brakes which are comprised of a bronze, graphitic composition and asbestos. The tractor fluid must demonstrate its ability to provide friction retention for power shift transmission clutches such as those clutches which include graphitic and bronze clutches.

U.S. Pat. No. 5,062,975 discloses a tractor fluid comprising a base oil with an additive package mixed therein. The additive package comprises (1) a calcium overbased sulfonate; (2) an EP/antiwear agent being a zinc salt of dialkyl phosphorodithioic acid; (3) a borated epoxide; and (4) a carboxylic solubilizer.

U.S. Pat. No. 5,284,591 discloses components (1) through (4) as recited in the paragraph immediately above in addition to (5), a sulfurized olefin.

U.S. Pat. No. 4,792,410 discloses a manual transmission fluid comprising (a) a borated overbased alkali or alkaline earth metal salt selected from the group consisting of sulfonates, phenates, oxylates, carboxylates and mixtures thereof;

(b) a friction modifier selected from the group consisting of fatty phosphites, fatty acid amides, borated fatty epoxides, fatty amines, glycerol esters and their borated derivatives, borated alkoxylated fatty amines, sulfurized olefins and mixtures thereof; and (c) an oil of lubricating viscosity, wherein such lubricants have excellent static and dynamic frictional characteristics. The lubricant fluids are particularly useful in reducing double detent and clashing during manual transmission shifting.

U.S. Pat. No. 4,410,438 discloses a lubricant and liquid fuel composition which includes borated epoxides which are indicated as being useful in fluids such as heat exchange fluids, transmission fluids, and hydraulic fluids.

U.S. Pat. No. 3,933,659 discloses a functional fluid for lubricating oil compositions which is comprised of a major amount of an oil of lubricating viscosity and an effective amount of an additive. The additive includes effective amounts of an alkaline succinimide, a group II metal salt of a dihydrocarbyldithiophosphoric acid, a basic sulfurized alkaline earth metal alkyl phenate and a component which is a fatty acid ester, fatty acid amide or fatty acid amine or mixtures thereof. The patent indicates that the lubricating compositions are useful as functional fluids in systems requiring fluid coupling, hydraulic fluid and/or lubrication of relatively moving parts. The lubricating compositions are indicated as being useful as the functional fluid in automatic transmissions and particularly in the automatic transmissions of passenger automobiles.

U.S. Pat. No. 3,953,347 discloses sulfurized compositions prepared by reacting, at about 100°–250° C., sulfur with a mixture comprising (A) 100 parts by weight of at least one fatty acid ester, (B) about 0–50 parts by weight of at least one fatty acid, and (C) about 25–400 parts by weight of at least one aliphatic olefin containing about 8–36 carbon atoms.

U.S. Pat. No. 4, 116,877 discloses an elastomer compatible seal swell additive. The additive may be used in connection with automatic transmission, power transmission fluids and hydraulic steering fluids. The fluid is a mineral lubricating base oil which includes an oil-soluble bis (hydrocarbyl) phosphite ester and an oil-soluble hydrocarbyl substituted phenol wherein a specific weight ratio is maintained with respect to the phosphite and phenol. The patent indicates that the inclusion of these particular additive compounds in the particularly disclosed ratio provides enhanced elastomer compatibility to the fluid.

U.S. Pat. No. 3,929,650 to King et al, issued Dec. 30, 1975, discloses borated overbased alkali metal carbonates of alkali or alkaline earth metal sulfonates. U.S. Pat. No. 3,480,548 to Hellmuth et al, issued Nov. 25, 1969, discloses overbased boronated products.

Published European Patent Application 113,199 published Jul. 11, 1984, discloses a tractor hydraulic fluid which includes oleyl phosphite in a tractor antifriction hydraulic fluid as well as thioethyloctadecenylsuccinate containing tractor hydraulic fluids.

British Patent 1,452,513 dated Oct. 13, 1976, discloses lubricant compositions which include a fatty acid and a fatty acid amide in a wet braking system for tractors which was found to be useful in reducing the amount of noise over a wide temperature range.

British Patent 1,440,261 discloses a composition for reducing the noise in the wet braking systems of tractors. The fluid was comprised of a lubricant oil, and a detergent or dispersant mixed with stearic acid. The composition indicated that it also included alkylene polyamine dispersants, calcium and barium sulfonates and phenates, antiwear-antioxidants and oleic acid.

SUMMARY OF THE INVENTION

A functional fluid, especially in the form of a tractor fluid is disclosed. The fluid comprises (1) a majority of a lubricating oil, wherein the functional fluid from said oil has at least 4 cSt kinematic viscosity at 100° C. and a –40° C. Brookfield viscosity of less than 20,000 cP. Also included in the fluid is an additive package which enhances gear antiwear performance of the fluid. The oil can comprise up to about 97 weight percent of said fluid.

The additive package, which can comprise up to 12% by weight of the functional fluid on an oil-free basis has for main components:

(2) an alkali or alkaline earth metal salt complex, said complex selected from the group consisting of:
  (a) a borated metal salt complex;
  (b) a mixture of borated and non-borated metal salt complex;

(3) an EP/antiwear agent comprising zinc salts of dialkylphosphorodithioic acid and 2-ethylhexanoic acid treated with triphenylphosphite or an olefin to reduce sulfur; and (4) a borated epoxide.

The additive package includes a calcium salt, and a mixture of zinc salts. The zinc salt mixture is comprised of zinc salts of dialkyldithiophosphate and carboxylic acids in which the zinc is present in an amount in excess of that necessary to neutralize the acids present.

The additive package further comprises a carboxylic solubilizer preferably in the form of an amine reaction product of a acylating agent containing a substituted hydrocarbyl-base substituent containing about 12 to 500 carbon atoms and a sulfurized composition in the form of a co-sulfurized mixture of two or more reactants selected from the group consisting of at least one fatty acid ester of a polyhydric alcohol, at least one olefin and at least one fatty acid. Specific amounts and ranges with respect to the additive and the five essential components are described below. However, since the additive may be used in a number of different types of fluids, these amounts might vary and might also vary somewhat due to other components in the additive.

The inventors have found that although there is some flexibility with respect to the amounts of each of these five essential components which must be present and the precise definition of each of these five components as generically described above, a useful functional fluid cannot be obtained if the amount limitations are completely ignored or if other components are randomly substituted for these five essential ingredients.

A primary object of this invention is to provide a functional fluid possessing a wide variety of different functional characteristics especially when used as a tractor fluid.

Another object of this invention is to provide a functional fluid capable of passing a wide variety of different tests with respect to characteristics such as EP/antiwear characteristics, water tolerance, brake capacity and chatter and filterability.

Still another object of the invention is to simultaneously provide improved performance in the areas of improved low temperature fluidity/filterability, EP/antiwear performance, friction improving properties, wet brake chatter suppression, and capacity with respect to actuating hydraulics, transmissions, power steering and braking without harming performance in other areas.

Yet another object is to increase performance with respect to EP/antiwear performance without having an undesirable effect on corrosion testing and transmission performance.

Still another object is to provide improved water tolerance by including surfactants while not limiting EP performance.

Other objects of this invention include providing a functional fluid capable of passing a wide variety of different tests with respect to characteristics such as frictional characteristics, low temperature fluidity, seal swell characteristics, antifoaming characteristics, antioxidation characteristics and EP protection as demonstrated by spiral bevel and straight spur gear testing.

Another object is to provide sufficient power steering performance while simultaneously providing sufficient transmission performance as demonstrated in Turbo Hydramatte oxidation testing (a General Motors Corp. test).

Another object is to provide a fluid which provides sufficient friction retention for power shift transmission clutches and provides corrosion inhibition, particularly with respect to yellow metal (i.e. copper, brass, bronze) corrosion while simultaneously providing improved EP performance, proper frictional properties for wet brake chatter suppression and simultaneously providing wet brake capacity and power take-off clutch performance.

A primary object of this invention is to provide a functional fluid which includes its essential components such that the fluid simultaneously provides a variety of desirable characteristics.

These and other objects of the invention will become apparent to those skilled in the an upon reading this disclosure.

DETAILED DESCRIPTION OF THE INVENTION

The present invention may be produced and sold in the form of the functional fluid final product which can be included in various mechanical devices such as tractors. However, the invention is generally produced in the form of a concentrate which is then substantially diluted within a hydrocarbon oil to form the final fluid. The concentrate itself is made up of various components which are themselves often contained within an oil of some type, i.e., a diluent or "dil" oil. This should be kept in mind with respect to the percentage pans by weight of the components present within the functional fluid. The pans by weight mentioned with respect to the amount of each of the components present within the functional fluid is the pans by weight of the active chemical, and not that component as it might be added in combination with its "dil" oil.

The five essential components of the additive package for use in the present functional fluid are: (1) calcium salt; (2) antiwear agent in the form of a group II metal dithiophosphate salt; (3) borated epoxide; (4) carboxylic solubilizer; and (5) sulfurized composition. Each of these five components as well as other components which are preferably present in the functional fluid of the invention will now be described in detail. It should be pointed out that none of these components themselves are per se novel compounds. However, the presence of these compounds in combination with each other does provide a novel functional fluid which provides improved characteristics not before obtainable. The components are necessary to provide the functional fluid having a base oil as described above with improved antiwear properties as determined by a spiral bevel gear test.

A variety of different types of metal salts have been disclosed and have been indicated as being especially valuable due to their detergent or dispersant properties and their ability to neutralize undesirable acid bodies formed in lubricants during the operation of the engine or device in which the lubricant is included. Such metal salts are generally in the form of overbased and/or neutral complexes with high molecular weight aliphatic carboxylic acids, sulfonic acids, anhydrides, esters, amides, imides or salts. These overbased complexes may be used as additives in lubricating oils, gasoline or other organic materials.

Overbased complexes in general are disclosed within U.S. Pat. No. 3,714,042 which is incorporated herein by reference for purposes of disclosing calcium salts and calcium salt complexes which might be used in connection with the present invention. The present inventors have found that although numerous other types of metal salts and metal salt complexes are generally used in the art, only calcium salts and calcium salt complexes provide the desirable characteristics of the functional fluid of the present invention. Further, it has now been found that it is preferable to include overbased and/or neutral calcium complexes in the form of overbased and/or neutral calcium sulfonates, overbased and/or neutral calcium sulfonate-carboxylates and overbased calcium carboxylates.

A mixture of overbased carbonated calcium complexes useful in connection with the functional fluid of the present invention can be formed by carbonating an oil-soluble sulfonic acid (e.g. sulfonic acids of the type comprising petroleum sulfonates, sulfonated alkyl benzenes, etc.) alone or in combination with a calcium alkyl phenate, a mixture of lower alcohols and an excess of lime. The oil-soluble sulfonic acid or mixture of acids and calcium alkyl phenate are overbased by the use of the lime. At this point, an overbased carbonated calcium complex has been formed. Such a complex can be used in connection with the present invention. However, it might be desirable to take the solution which has been overbased with lime and then stabilize it by post treating the complex with a polyisobutene substituted succinic anhydride. The overbased calcium complex used in connection with the present invention may be used in combination with other similar compounds, e.g., including calcium sulfonates which are combined with calcium phenates. This component of the invention is likely to contain a mixture of neutral and overbased salt complexes.

The use of the term "complex" refers to basic metal salts which contain metal in an amount in excess of that present in a neutral or normal metal salt. The "metal ratio" characterizing a complex is thus the ratio of the total equivalents of metal to the equivalents of metal in the form of neutral or normal metal. The "base number" of the complex is the number of milligrams of KOH to which one gram of the complex is equivalent as measured by titration.

The "base number" of the calcium complexes used in connection with the present invention varies over a range of up to about 800 TBN. As such complex is present within a diluent oil, the base number of the calcium complex is preferably in the range of from about 200 to about 400 and more preferably about 300.

In the present invention, the metal salt complex must include some calcium metal salt complex. However, there may also be present other metal salt complexes and there may be present calcium salts which are not "overbased."

A useful calcium complex for use in connection with the present invention can be prepared by the following procedure:

To 950 grams of a solution of a basic, carbonated calcium salt of an alkylated benzene sulfonic acid (average molecular weight 385) in mineral oil (base number about 300, calcium-12.0 percent and sulfur-1.4 percent) there is added 50 grams of polyisobutene (molecular weight 1000)-substituted succinic anhydride post treatment (having a saponification number of 100) at 25° C. Mixture is stirred for 0.65 hours at 55°–57° C. and then at 152°–153° C. for 0.5 hours and filtered at 150° C. The filtrate has a base number of about 300 and contains 53 percent of mineral oil.

A further useful overbased calcium salt mixture can be prepared as outlined below for an overbased calcium sulfonate, formaldehyde coupled phenol product. In this 1000 parts by weight of a 240 conversion calcium sulfonic acid, 316 parts by weight diluent oil and 52.6 parts by weight calcium based formaldehyde coupled phenol (oil content about 65%) are mixed at 140° F., then 1.7 parts by weight calcium chloride added in water. 176 pans by weight methanol and 88.4 parts by weight of a 2 to 1 mixture of butyl/amyl alcohols added. The temperature is adjusted to 115°–125° F. and sequential additives of lime and $CO_2$ follow. The overbasing continues until the desired range is met. The overbasing on an oil-free basis can range as high as 600–800 TBN.

Borated salt complexes are described in detail in U.S. Pat. No. 4,792,410 which is incorporated herein by reference. As a primary ingredient to improve gear wear performance in functional fluid applications, a borated overbased sulfonate is added to the fluid at about a weight level in the range of 0.5–8 weight percent based on the weight of the final fluid. The preferred range is 1–3 weight percent. The metal salt complex contained in the functional fluid may also contain an unborated salt complex with the weight percent of the metal salt mixture being as stated above for the borated material.

The metal salt complexes are sulfonate salts having a substantially oleophilic character and which are formed from organic materials. Organic sulfonates are well known materials in the lubricant and detergent arts. The sulfonate compound should contain on average from about 10 to about 40 carbon atoms, preferably from about 12 to about 36 carbon atoms and preferably from about 14 to about 32 carbon atoms on average. Similarly, the phenates and carboxylates have a substantially oleophilic character.

While the present invention allows for the carbon atoms to be either aromatic or in a paraffinic configuration, it is highly preferred that alkylated aromatics be employed. While naphthalene based materials may be employed, the aromatic of choice is the benzene moiety.

The most preferred composition is thus a monosulfonated alkylated benzene. Typically, alkyl benzene fractions are obtained from still bottom sources and synthetic routes and are mono- or di-alkylated. It is believed in the present invention that the dialkylated, aromatic sulfonates are superior to the mono-alkylated sulfonates in overall properties.

It is desired that a mixture of alkylated aromatics (benzene) be utilized to obtain the alkylated salt (benzene sulfonate) in the present invention. The mixtures wherein a substantial portion of the composition contains polymers of propylene as the source of the alkyl groups assists in the solubility of the salt in the fluid. The use of mono-functional (e.g., mono-sulfonated) materials avoids crosslinking of the molecules with less precipitation of the salt from the lubricant.

It is also desired that the salt be "overbased". By overbasing, it is meant that a stoichiometric excess of the metal be present over that required to neutralize the oil soluble sulfonic acid. The excess metal from overbasing has the effect of neutralizing acids which may build up in the lubricant. A second advantage is that the overbased salt increases the dynamic coefficient of friction. Typically, the excess metal will be present over that which is required to neutralize the sulfonic acid at about 10:1 to 30:1, preferably 11:1 to 18:1 on an equivalent basis.

The alkali metal borate dispersion may be prepared by the following steps: a suitable reaction vessel is charged with the alkaline metal carbonate overbased metal sulfonate within the oleophilic reaction medium (typically the hydrocarbon medium employed to prepare the overbased metal sulfonate). The boric acid is then charged to the reaction vessel and the contents vigorously agitated.

The reaction is conducted for a period of 0.5 to 7 hours, usually from 1 to 3 hours at a reaction temperature of 20° to 200° C., preferably from 20° to 150° C., and more preferably from 40° to 125° C. At the end of the reaction period, the temperature is raised to 100° to 250° C., preferably from 100° C. to 150° C. to strip the medium of any residual alcohol and water. The stripping may be done at atmosphere pressure or under reduced pressure of 93 KPa to 1 KPa Hg.

The amount of borated overbased sulfonate which may be present in the oleophilic lubricating oil may vary from 0.1 to 65 weight percent depending on whether a concentration or final lubricant is desired. Generally, for concentrates, the borate content varies from 20 to 50 weight percent, and preferably from 35 to 45 weight percent. For lubricants, the amount of borate generally varies from 0.1 to 15 weight percent and preferably from 1 to 10 weight percent.

The borate dispersions are conveniently alkaline earth and alkali metal borates. The preferred metals are calcium, magnesium and barium.

A preferred boronated product useful herein may be obtained from a process for obtaining a high carbonate content borated product comprising:

(a) mixing an overbased sulfonate and any required inert liquid medium, (b) borating the mixture (a) with a borating agent at a temperature less than that at which substantial foaming occurs, (c) raising the temperature of the mixture (b) to that temperature in excess of the boiling point of water within the mixture (b), (d) separating substantially all of the water from the reaction mixture and, (e) recovering the product (d) as a high carbonate content borated product.

A process for obtaining a high carbonate content overbased borated product containing at least about 5% by weight of carbon dioxide wherein the product is obtained by:

(a) mixing an overbased component and any required inert liquid medium, (b) reacting component (a) in the presence of a borating agent to a boron content of at least about 3% by weight of the product, (c) reducing the water content of the product (b) to less than about 3% by weight and, (d) recovering the high carbonate content overbased borated product.

The products of the above processes as well as an overbased borated product having a mean particle diameter of less than about 9 microns is also described as follows:

The EP/antiwear agent used in connection with the present invention is in the form of a zinc dithiophosphate. Although there are an extremely large number of different types of antiwear agents which might be utilized in connection with such functional fluids, the present inventors have found that zinc dithiophosphate type antiwear agents work particularly well in connection with the other components to obtain the desired characteristics. Particularly useful zinc dithiophosphate antiwear agents are disclosed within U.S. Pat. No. 4,263,150 which is incorporated herein by reference for the purposes of disclosing preferred zinc dithiophosphates.

It has been found that salts of dialkylphosphorodithioic acids which are treated with phosphites and/or olefins work particularly well in connection with the present invention. More specifically, treating such salts or their acid precursors with a triaryl phosphite, and specifically, triphenyl phosphite, provide results which work particularly well in connection with the functional fluid and particularly the tractor fluid of the present invention. By treating these zinc salts or their acid precursors with triaryl phosphite compounds, the treated zinc salts have a reduced tendency to stain and corrode the metal parts that they are used in connection with. Specifically, such treated zinc salts or acid precursors are much less likely to stain or corrode copper parts.

The salts of dialkylphosphorodithioic acids are known to be useful with respect to their antiwear properties as used within lubricating compositions. However, the antiwear agents used in connection with the present invention have removed the sulfur activity of such zinc salts by some means. One means for removing the sulfur activity involves treating the salt or their acid precursors with phosphites. For example, an antiwear agent useful in connection with the present invention can be prepared by the following method:

Triphenylphosphite is heated with a zinc dialkylphosphorodithioate or a mixed zinc salt of a dialkylphosphorodithioic acid and a carboxylic acid. The dialkylphosphorodithioic acid used in the preparation of the zinc salt is itself prepared by the reaction of at least one alcohol with phosphorus pentasulfide which contains a stoichiometric excess of sulfur.

The zinc dithiophosphate component of the present invention is added in an amount sufficient to improve antiwear properties of the fluid and as used in a tractor fluid is present in an amount of about 1 percent to about 4 weight percent based on the weight of the fluid.

A preferred embodiment of EP/antiwear agents incorporated basic zinc salts, that is, salts in which zinc is present in a stoichiometric excess over that which is needed to neutralize the acids present in the EP/antiwear component. In the preferred embodiment, the zinc is present in about a 33% excess based on moles of zinc oxide per mole of acidic material.

A useful EP/antiwear agent comprises forming a phosphorodithioic acid by reacting 2-ethylhexanol with phosphorous pentasulfide to form the dialkyl phosphorodithioic acid, adding a specified amount of zinc oxide to this acid and 2-ethylhexanoic acid and then adding a $C_{16}$–$C_{18}$ $\alpha$-olefin mixture and heating the mixture at 240°–260° F. for three hours. The zinc is present in mixture at about a 30–40% excess as zinc oxide. The weight ratio of 2-ethylhexanol to 2-ethylhexanioic acid used is about 50:1, but may in the range of 1:1 and ranges between the two given ranges. The zinc component is included in the function fluid in a concentration of about 0.5–10 weight percent with the preferred range being about 1–3 weight percent.

Various boron-containing compounds are known to be useful in connection with functional fluids. It has now been found that borated epoxides work particularly well in combination with the other components described herein to provide a functional fluid with improved characteristics. Such borated epoxides are obtained by reacting an epoxide of the general structural formula:

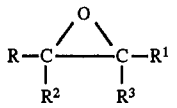

wherein R, $R^1$, $R^2$ and $R^3$ are hydrogen or a $C_{8-30}$ hydrocarbyl group, at least one of which is hydrocarbyl, with boric acid, boric oxide or an alkyl borate of the formula $(RO)_xB(OH)_y$ wherein x is 1 to 3 and y is 0 to 2, their sum being 3, or boric oxide and R is an alkyl group containing 1 to 6 carbon atoms. Such borated epoxide compounds are disclosed within U.S. Pat. No. 4,410,438 incorporated herein by reference for purposes of disclosing the borated epoxide component used in connection with the present functional fluid.

One preferred borated epoxide is obtained as the result of reacting boric acid with 1,2-epoxide mixture with the epoxide containing about 16 carbon atoms.

It is possible to prepare a borated epoxide useful in connection with the present invention by including 1,2-epoxide hexadecane in combination with boric acid. The mixture is heated to about 180° C. in the presence of water and toluene. The reaction may be carried out in the presence of a diluent oil. The resulting product is a borated epoxide compound which is useful in connection with the functional fluid of the present invention.

The borated epoxide is present in an amount sufficient to provide the fluid with an ability to pass fluid related tests and for a tractor fluid is present in an amount of about 0.1 to 2 weight percent based on the weight of the functional fluid.

Another essential component of the present functional fluid is a carboxylic solubilizer. This component is capable of interacting with other components in such a manner so as to provide a microemulsion of water particles so as to provide improved water tolerance and filterability. The carboxylic solubilizer component is present in sufficient amount so as to provide these characteristics, i.e., improved water tolerance and filterability, and for a tractor fluid is about 0.1 percent to about 2 weight percent based on the weight of the fluid. Preferred examples of such carboxylic solubilizers are disclosed within U.S. Pat. No. 4,435,297 which in incorporated herein by reference for purposes of disclosing carboxylic solubilizers useful in connection with the present functional fluid.

The carboxylic solubilizers used in connection with the present functional fluid are nitrogen-containing phosphorus-free carboxylic acid derivatives. These derivatives are made by reacting an acylating agent with an alkanol tertiary monoamine. It has now been found that particular solubilizing agents work particularly well in connection with functional fluids and especially those functional fluids useful as tractor fluids. The most preferred carboxylic solubilizer found by the inventor is the product of a reaction of polybutylene succinic anhydride with N,N-diethylethanolamine at a molar ratio of 1:2. The resulting product is predominantly an ester salt and contains a small amount of diester. Further, the product may contain small amounts of free unreacted polybutylene and trace amounts of maleic anhydride reacted with N,N-diethylethanolamine.

The carboxylic solubilizer most preferably used in connection with the present invention is a nitrogen-containing, phosphorous-free carboxylic acid derivative which is obtained by the reaction at a temperature in the range of about 30° C. to the decomposition temperature of one or more of the reacting components of (A) a carboxylic acid acylating agent with (B) an alkanol tertiary monoamine. The acylating agent has at least one hydrocarbyl substituent containing about 20 to about 500 carbon atoms and the monoamine (B) has one hydroxyl group and a total of up to about 40 carbon atoms.

The base oil of lubricating viscosity comprises natural and synthetic oils in about 80–98 weight percent of the functional fluid. Natural oils include animal, vegetable and mineral lubricating oils. The important criteria of the base oil is that it has viscosity properties which ensure functional performance at low temperature for the functional fluid. The preferred viscosity limitations for the fluid in which the base oil comprises a majority component is a fluid composition having a 100° C. kinematic viscosity of at least 4 cSt and a −40° C. Brookfield viscosity maximum of 20,000 cP. An example of a base oil meeting these parameters is a nominally 7cSt (at 100° C. kinematic viscosity) oil made up of a mixture of 65% Sun Tulsa 65–70N oil and 35% Sun Tulsa 160N oil.

A preferred lubricant base for use herein is the mineral oil mixture stated above. The term mineral oil is used in its conventional definition. The synthetic lubricating oils useful herein include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecyl-benzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diphenyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of tinoleic acid dimer, and complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy- or polyaryloxy-silane oils and silicate oils comprise another useful class of synthetic lubricants (e.g., tetraethyl silicate, tetraisopropyl silicate, tetra-(2-ethylhexyl) silicate, tetra-(4-methyl-hexyl) silicate, tetra-(p-tert-butylphenyl) silicate, hexyl(4-methyl-2-pentoxy)-disiloxane, poly(methyl)siloxanes, poly(methylphenyl)-siloxanes, ect.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Polyolefin oligomers are typically formed by the polymerization reaction of alpha-olefins. Nonalpha-olefins may be oligomerized to give a synthetic oil within the present invention, however, the reactivity and availability of alpha-olefins at low cost dictates their selection as the source of the oligomer.

The polyolefin oligomer synthetic lubricating oils of interest in the present invention include hydrocarbon oils and halo-substituted hydrocarbon oils such as are obtained as the polymerized and interpolymerized olefins, e.g., oligomers, include the polybutylenes, polypropylenes, propylene-isobutylene copolymers, chlorinated polybutylenes, poly(1-hexenes), poly(1-octenes), poly(1-decenes), similar materials and mixtures thereof.

Typically, the oligomer is obtained from a monomer containing from about 6 to 18 carbon atoms, preferably from about 8 carbon atoms to about 12 carbon atoms. Most preferably, the monomer used to form the oligomer is decene, and preferably 1-decene. The nomenclature alpha-olefin is a trivial name and the IUPAC nomenclature of a 1-ene compound may be considered to have the same meaning within the present invention.

While it is not essential that the oligomer be formed from an alpha-olefin, such is desirable. The reason for forming the oligomer from an alpha-olefin is that branching will naturally occur at the points where the olefin monomers are joined together and any additional branching within the backbone of the olefin can provide too high a viscosity of the end oil. It is also desirable that the polymer formed from the alpha olefin be hydrogenate. The hydrogenation is conducted according to known practices. By hydrogenating the polymer-free radical attack on the allyic carbons remaining after polymerization is minimized.

The molecular weight of the oligomer is typically averaged from about 250 to about 1400, conveniently from about 280 to about 1200 preferably from about 300 to about 1100 and most preferably about 340 to about 520. The choice of molecular weight of the oligomer is largely dependent upon whether a viscosity improver is included within the formulation. That is, the polyolefin oligomer may require either a thickening or a thinning effect to ensure that the proper lubricating viscosities are maintained under extreme heat and cold conditions.

A further desirable synthetic lubricant is an alkylated aromatic compound. The alkylated aromatic compounds are particularly beneficial in improving the low temperature flow characteristics. The alkylated aromatics may be referred to, supra, under the discussion of the alkaline earth metal salt. The alkylated aromatics are the same base materials utilized to manufacture the aromatic sulfonate.

The alkylated aromatic compound may be obtained in mixture with the sulfonate due to incomplete sulfonation of the alkylated aromatic. Of course, the alkylated aromatic may be obtained directly. Preferably, the aromatic nucleus of the alkylated aromatic compound is benzene. A particularly useful synthetic lubricant is a mixture of the alpha olefin oligomer and the alkylated aromatic. Typically, a mixture of the oligomer to the alkylated aromatic will be at a weight ratio of about 8:1 to about 1:8.

In addition to the components listed above, those being the base oil with given parameters for viscosity, the borated metal salt or a mixture of borated metal salts with an unborated metal salt, the EP antiwear agent and the borated epoxide; several other components can be included in the additive package and in the function fluid when the additive package is mixed with the proper base oil.

The inclusion of carboxylic solubilizers in the additive package and functional fluid allows for the interaction of this component with water to form microemulsions in the formulations so as to provide improved water tolerance and filterability.

The carboxylic solubilizer component is present in sufficient amounts so as to provide these characteristics, i.e., improved water tolerance and filterability, and for a tractor fluid is about 0.1 percent to about 2 weight percent based on the weight of the fluid. Preferred examples of such carboxylic solubilizers are disclosed within U.S. Pat. Nos. 4,435,297 and 5,372,738, which are incorporated herein by reference for purposes of disclosing carboxylic solubilizers useful in connection with the present functional fluid.

The carboxylic solubilizers used in connection with the present functional fluid are nitrogen-containing carboxylic acid derivatives. These derivatives are made by reacting an acylating agent with an alkanol tertiary monoamine. It has now been found that particular solubilizing agents work particularly well in connection with functional fluids and especially those functional fluids useful as tractor fluids. The most preferred carboxylic solubilizer found by the inventors is the product of a reaction of polybutylene succinic anhydride with N,N-diethylethanolamine at a molar ratio of 1:2. The resulting product is predominantly an ester salt and contains a small amount of diester. Further, the product may contain small amounts of free unreacted polybutylene and trace amounts of maleic anhydride reacted with N,N-diethylethanolamine.

The carboxylic solubilizer most preferably used in connection with the present invention is a nitrogen-containing carboxylic acid derivative which is obtained by the reaction at a temperature in the range of about 30° C. to the decomposition temperature of one or more of the reacting components of (A) a carboxylic acid acylating agent with (B) an alkanol tertiary monoamine. The acylating agent has at least one hydrocarbyl substitutent containing about 20 to about 500 carbon atoms and the monoamine (B) has one hydroxyl group and a total of up to about 40 carbon atoms.

In addition, the present functional fluid/additive package preferably includes a viscosity improving agent and an antifoaming agent. The type and amount of each component is adjusted depending on factors such as the temperature of operation, the desired viscosity and amount of agitation the fluid is subjected to and the amount of foaming permitted. Since a functional fluid is likely to be utilized in equipment over a wide temperature range, the inclusion of the viscosity improving agent in order to aid in the regulation of the viscosity of the fluid is highly desirable. The viscosity improver is generally present in an amount of about 0.5 to about 8 weight percent based on the weight of the fluid. Further, since the fluid is generally subjected to substantial mechanical agitation and pressure, the inclusion of an antifoaming agent is highly desirable in order to reduce and/or eliminate foaming which could create problems with the mechanical operation of the device the fluid is used in connection with. The antifoaming agent is generally present in an amount of about 0.005 to about 0.08 parts by weight based on the weight of the fluid.

Some useful viscosity index improvers include well-known polymethacrylate compounds, hydrogenated styrene-butydiene viscosity improvers and styrene-malan copolymers. A useful antifoaming agent includes a combination of about 90 weight percent of kerosene and about 10 weight percent of a silicone agent (DC 200, VIS 30,000 cSt at 25° C.).

The functional fluid of the present invention can be in the form of various specific types of functional fluids such as hydraulic/transmission fluids, brake fluids, power steering fluids and tractor fluids, the precise composition of which might vary slightly. The precise composition of such fluids can be formulated by those skilled in the art upon reading the present disclosure and considering the characteristics of the fluid which are effected by the components and the amount ranges disclosed. In order to provide the present invention in the form of a final product, it is necessary to include the essential components within a base oil of lubricating viscosity. The four essential components in the form of active chemicals are present within the hydrocarbon oil in an amount in the range of about 0.5 percent to about 10 weight percent based on the total weight of the functional fluid of the invention. Accordingly, the base oil is present in the amount in the range of about 81.5 percent to about 99.5 percent based on the total weight of the functional fluid.

The essential components of the present invention could be included by themselves or in combination with other components within a concentrate. The concentrate could contain from about 1 percent to about 99 weight percent of the active chemical with the remainder of the concentrate being comprised of a hydrocarbon oil.

When formulating a tractor fluid, the base oil of lubricating viscosity is generally present in an amount in the range of about 81.5 weight percent to about 99.5 weight percent. The individual essential components of the tractor fluid are present in the following amounts: the calcium salt is present in an amount of about 0.5 weight percent to about 5.5 weight percent; the EP/antiwear agent is present in an amount of about I percent to about 4 weight percent; the borated epoxide is present in an amount of about 0.1 percent to about 1.5 weight percent and the carboxylic solubilizer is present in the amount of about 0.1 percent to about 1 weight percent, with all of the amounts being based on parts by weight of the active chemical in the tractor fluid as a whole.

A further component of the present functional fluid is a sulfurized composition. This component is capable of acting as a co-solvent which permits the addition of viscosity improvers to a functional fluid composition without the addition of diluent oil; that is, concentrate compatibility of viscosity improvers is enhanced. The sulfurized composition component is present in a sufficient amount to improve compatibility, and for a tractor fluid is about 0.5 weight percent based on the weight of the fluid.

A useful sulfurized composition for use in connection with the present invention is prepared by the following procedure:

To a mixture of 100 parts soybean oil, 5.4 parts of tall oil acid and 45.3 parts of a $C_{16-18}$ alpha olefin at 136° C. under nitrogen is added over 30 minutes, with stirring 17.7 parts of sulfur. An exothermic reaction occurs which causes the temperature to rise to 185° C. The contents are heated to 160° C. –175° C. for 3 hours, cooled to 90° C. and filtered to yield the desired product which contains 10.0% sulfur.

The sulfurized composition comprises a co-sulfurized mixture of two or more reactants selected from the group consisting of at least one fatty acid ester of a polyhydric alcohol, at least one olefin and at least one fatty acid.

The fatty acid which is reacted with the polyhydric alcohol may be obtained by the hydrolysis of a naturally occurring vegetable or animal fat or oil. These acids usually contain from 8 to 22 carbon atoms and include, for example, caprylic acid, caproic acid, palmitic acid, stearic acid, oleic acid, linoleic acid, etc. Acids containing 16 to 20 carbon atoms are preferred, and those containing 16 to 18 carbon atoms are especially preferred. Also preferred are fatty acids having olefinic unsaturation.

Suitable polyhydric alcohols will have from 2 to about 12 carbon atoms, preferably from 2 to about 5 carbon atoms, and from 2 to about 8 hydroxyl groups, preferably 2 to about 4 hydroxyl groups, most preferably about 3 hydroxyl groups. Examples of suitable polyhydric alcohols include ethylene glycol, propylene glycol, trimethylene glycol, neopentylene glycol, glycerol, pentaerythritol, etc. Ethylene glycol and glycerol are preferred; glycerol is especially preferred. Polyhydric alcohols containing alkoxy groups, particularly ethoxy groups or propoxy groups, are contemplates.

A fatty acid may be utilized as part of the co-sulfurization mixture and may be least one fatty acid as described above. It is usually an unsaturated fatty acid such as oleic or linoleic acid, and may be a mixture of acids such as is obtained from tall oil or by the hydrolysis of peanut oil, soybean oil or the like.

The olefin employed is preferably an aliphatic olefin. That is, it is essentially free of aromatic groups such as phenyl groups, naphthyl groups and the like. The olefin usually will contain from about 4 to about 40 carbon atoms, preferably from about 8 to about 36 carbon atoms. Terminal olefins, or alpha-olefins, are preferred, especially those having from 12 to 20 carbon atoms. Olefins having internal double bonds are also useful. Mixtures of these olefins are commercially available, and such mixtures are contemplated for use in this invention.

The co-sulfurized mixture is prepared by reacting the mixture of appropriate reactants with a sulfur source. The mixture to be sulfurized contains at least two or more of the following reactants: from about 10 to about 90 parts, more often from about 35 to about 675 parts by weight of at least one fatty acid ester of a polyhydric alcohol; from about 0.1 to about 15 parts, more often about 1 to about 5 parts by weight of at least one fatty acid; and about 10 to about 90 parts, often from about 15 to about 60 parts, more often from about 25 to about 35 parts by weight of at least one olefin.

The sulfurization reaction generally is effected at an elevated temperature, often from about 50° to about 350° C, more preferably, at a temperature of from about 100° to about 210° C. The reaction is effected with efficient agitation and often in an inert atmosphere such as nitrogen. If any of the reagents are appreciably volatile at the reaction temperature, the reaction vessel may be sealed and maintained under pressure. Although generally not necessary, the reaction may be effected in the presence of an inert solvent such as an alcohol, ether, ester, aliphatic hydrocarbon, halogenated aromatic hydrocarbon, etc., which is a liquid within the temperature range employed for the reaction.

The sulfurizing agents useful in the process of the present invention include elemental sulfur, hydrogen sulfide, sulfur halide, sodium sulfide and a mixture of hydrogen sulfide and sulfur or sulfur dioxide, etc. Preferably, the sulfurizing agent is elemental sulfur. It is frequently advantageous to add the sulfurizing agent portionwise to the mixture of the other reagents. When elemental sulfur is utilized as a sulfurizing agent, the reaction is in some instances exothermic, which can be utilized as a cost-cutting benefit since no, or at least reduced, external heating may be required. The amount of sulfur or sulfurizing agent added to the reaction mixture can be varied over a wide range although the amount included in the reaction mixture should be an amount sufficient to provide a sulfurized product containing the desired amount of sulfur.

Usually, the amount of sulfur or sulfurizing agent employed in the preparation of the sulfurized component of this invention is calculated based on the total olefinic unsaturation of the mixture. A monoolefinic reactant, such as an alpha-olefin or oleic acid, for example, contains one mole of olefinic bonds per mole of reactant. A polyolefinic material contains 2 more moles of olefinic bonds. For example, 1,4-hexadiene contains 2 moles of olefinic bonds. In general, from about 0.05 to about 6 moles of sulfur, present as elemental sulfur or as sulfur present in another sulfurizing reactant, may be employed per mole of olefinic bonds. More often from 0.5 to about 3 moles of sulfur are employed per mole of olefinic bonds.

Accordingly, the sulfur content of any given sulfurized composition useful in this invention depends on the amount of sulfur present in the sulfurization mixture and on the nature and amount of the reactants present in the mixture comprising the fifth essential component. Compositions containing from 2 to about 40 weight percent sulfur are common and preferred are those containing from about 5 to about 25 weight percent of sulfur.

Sulfurized olefin compositions for use in lubricating and functional fluid are disclosed in U.S. Pat. Nos. 4,119,549, 4,119,550, 4,191,659 and 4,344,854 which are incorporated herein by reference for disclosure pertinent to this invention. A preferred sulfurized component for inclusion in this invention is sulfurized 2-butene prepared according to procedures in the above cited patents. Typically, an olefin such as 2-butene, 1000 parts by weight is reacted with 486 parts of sulfur and 304 parts of $H_2S$ and 1.5 parts n-butylamine is reacted at 340°–350° F to form a butene polysulfide.

In addition to the components described above, the present functional fluid preferably includes a viscosity improving agent and an antifoaming agent. The type and amount of each component is adjusted depending on factors such as the temperature of operation, the desired viscosity and amount of agitation the fluid is subjected to and the amount of foaming permitted. Since a functional fluid is likely to be utilized in equipment over a wide temperature range, the inclusion of the viscosity improving agent in order to aid in the regulation of the viscosity of the fluid is highly desirable. The viscosity improver is generally present in an amount of about 0.5 to about 8 weight percent based on the weight of the fluid. Further, since the fluid is generally subjected to substantial mechanical agitation and pressure, the inclusion of an antifoaming agent is highly desirable in order to reduce and/or eliminate foaming which could create problems with the mechanical operation of the device the fluid is used in connection with. The antifoaming agent is generally present in an amount of about 0.005 to about 0.08 parts by weight based on the weight of the fluid.

Some useful viscosity index improvers include well-known polymethacrylate compounds, hydrogenated styrene-butadiene viscosity improvers and styrene-malan copolymers. A useful antifoaming agent includes a combination of about 90 percent by weight of kerosene and about 10 percent by weight of a silicone agent (DC 200, VIS 30,000 cSt at 25° C.).

The functional fluid of the present invention can be in the form of various specific types of functional fluids such as hydraulic/transmission fluids, brake fluids, power steering fluids and tractor fluids, the precise composition of which might vary slightly. The precise composition of such fluids can be formulated by those skilled in the art upon reading the present disclosure and considering the characteristics of the fluid which are effected by the components and the amount ranges disclosed. In order to provide the present invention in the form of a final product, it is necessary to include the five essential components within a base oil of lubricating viscosity. The components in the form of active chemicals are present within the base oil of lubricating viscosity in an amount in the range of about 2.2 percent to about 17.0 weight percent based on the total weight of the functional fluid of the invention. Accordingly, the base oil is present in the amount in the range of about 83 percent to about 97.8 percent based on the total weight of the functional fluid.

When formulating a tractor fluid, the base oil of lubricating viscosity is generally present in an amount in the range of about 83.0 weight percent to about 97.8 weight percent. The individual essential components of the tractor fluid are present in the following amounts: the calcium salt is present in an amount of about 0.5 weight percent to about 5.5 weight percent; the EP/antiwear agent is present in an amount of about 1 percent to about 4 weight percent; the borated epoxide is present in an amount of about 0.1 percent to about 1.5 weight percent, the carboxylic solubilizer is present in the amount of about 0.1 percent to about 1 weight percent and the sulfurized composition is present in an amount of about 0.5 weight percent to about 5.0 weight percent, with all of the amounts being based on parts by weight of the active chemical in the tractor fluid as a whole.

In a particularly preferred embodiment of the present invention, the calcium salt is present in an amount of about 0.5–1.5 weight percent on an oil free basis or about 2–4 weight percent with its diluent oil. The calcium salt is a 1:1 mixture weight of borated and non-borated calcium overbased sulfonate. The EP/antiwear agent is present in an amount of about 1.7 weight percent; the borated epoxide is present in an amount of about 0.4 weight percent, the carboxylic solubilizer is present in an amount of about 0.25 weight percent. The sulfurized composition, if present, is in an amount of about 0.25 weight percent of active chemical based on the weight of the tractor fluid as a whole.

The calcium salt has mixed therein about 5 weight percent, based on the weight of the calcium salt if used in the overbasing procedure, of a formaldehyde coupled phenol which is incorporated at the overbasing stage. The calcium salt may further comprise about 0.5–2 weight percent, based on the weight of the calcium salt used in the functional fluid of a 1000 $\overline{Mn}$ polyisobutene substituted succinic acid or anhydride.

EXAMPLE 1

A composition of the present invention is made if as listed below and is used in a spiral bevel test to determine gear wear.

(a) About 92–93 weight percent comprising 65% 70N and 35% 160N oils;

(b) 1.5 weight percent 1:1 mixture of borated/non-borated overbased calcium sulfonate treated with about 0.5 weight percent (based on the weight of the calcium salt) of polyisobutene substituted succinic anhydride containing about 0.75 weight percent formaldehyde coupled phenol (based on the weight of the calcium salt);

(c) 2.6 weight percent of maleic anhydride-styrene co-polymer esterified with a mixture of $C_{12-18}$ alcohols, $C_{8-10}$ alcohols and $C_4$ alcohol with residual acidity neutralized with aminopropyl-morpholine;

(d) 1.7 weight percent EP/antiwear agent;

(e) 0.4 weight percent borated epoxide; and (f) 0.25 weight percent carboxylic solubilizer.

The above formulation has a 100° C. kinematic viscosity of 7.14 cSt. The formulation, when run in the John Deere spiral bevel gear test, produces markedly improved results over the same formulation using only unborated calcium salt. The spiral bevel gear test is identified as JDQ95. This test may be ordered through Southwest Research Institute, San Antonio, Tex., U.S.A.

EXAMPLE 2

The list below gives ranges of components which may be used to formulate compositions covered by this invention:

a) 75 weight percent or greater of a base oil. The base oil and additives disclosed therein give a function fluid of 100° C. kinematic viscosity of greater than 4 cSt and a −40° C. Brookfield viscosity of less than 20,000 cPs.

b) 0.5–5.5 weight percent borated overbased calcium salt or a mixture of borated and non-borated overbased calcium salts. If a mixture, the borated to non-borated ratio is 0.1:3 to 1:0.05. The calcium salts may contain, based on the weight of calcium salt, about 0.5–1.5 weight percent formaldehyde coupled phenol and/or about 2–5 weight percent 1000 $\overline{Mn}$ polybutene substituted succinic anhydride or succinic acid. The preferred total base number is in the range of 600, but values of up to 800 may be employed. The weight ratio of salt to $H_3BO_3$ is preferably 9:1 but other proportions may be used.

c) 0.5–5 weight percent EP/antiwear agent. The preferred antiwear agent is an alkaline zinc dialkyldithiophosphate in admixture with a zinc salt of an alkylcarboxylic acid in which the zinc is present in about one-third excess of that needed to neutralize the acid groups based on equivalents of zinc oxide. The EP/antiwear agent has been treated with triary phosphite or $C_{16}$–$C_{18}$ α olefin to reduce sulfur.

d) 0.1–1.5 weight percent borated epoxide. The preferred borated epoxide is a epoxidized $C_{16}$-α olefin. Other epoxides and mixtures thereof may be used.

e) 0.1–2 weight percent of a carboxylic solubilizer. The preferred solubilizer is an ester-salt reaction product of an acylating agent containing a 12–500 carbon hydrocarbyl group with a tertiary amine.

f) 0.5–5 weight percent of a sulfurized material, the sulfurized material being sulfurized olefins, sulfurized fatty acids and sulfurized fatty acid ester of polyhydric alcohols and mixtures thereof. The preferred component is sulfurized isobutene.

g) 0.5–8 weight percent of a viscosity modifier. The preferred viscosity modifier is a malan-styrene copolymer esterified with aliphatic alcohols and having residual acidity neutralized with aminopropylmorpholine.

What is claimed is:

1. A functional fluid composition having improved low temperature and antiwear properties, said composition comprising:

A. A major amount of an oil of lubricating viscosity;

B. A minor amount of an additive package; said package comprising:

(1) An alkali or alkaline earth metal salt complex, said complex selected from the group consisting of:

(a) a borated metal salt complex;

(b) a mixture or borated and non-borated metal salt complexes wherein said complex has a TBN of up to 800 on an oil free basis;

(2) An EP/antiwear agent in the form of a zinc salt selected from the group consisting of (a) zinc salts of dialkylphosphorodithioic acid; and (b) a mixture of zinc salts of dialkylphosphorodithioic acid and zinc salts of carboxylic acids;

(3) a borated epoxide;

wherein said composition has a 100° C. kinematic viscosity of at least 4cSt, a −40° C. Brookfield viscosity maximum of 20,000 cP, and wherein said composition passes the JDQ95 Spiral Bevel Gear Test.

2. The composition according to claim 1, wherein said metal is calcium.

3. The composition according to claim 1, wherein said salt complexes have a TBN of up to 800.

4. The composition according to claim 1, wherein said boron content of said borated metal salt is about 1–10 weight percent based on the weight of said salt.

5. The composition according to claim 1, wherein the weight ratio of borated to non-borated metal salts in said mixture of salts is 0.1:3 to 1:0.05.

6. The composition according to claim 1, wherein said zinc salts are those of bis-(2-ethylhexyl)dithiophosphate and 2-ethylhexanoic acid.

7. The composition according to claim 1 wherein said zinc salts are treated with triarylphosphite or an olefin to remove sulfur.

8. The composition according to claim 1, wherein said borated epoxide is the reaction product of boric acid with a 1,2 epoxide containing about 16 carbon atoms.

9. The composition according to claim 1, wherein said composition further comprises a carboxylic solubilizer in the form of an ester salt reaction product of an acylating agent containing a substituted hydrocarbyl-based substituent containing about 12 to about 500 carbon atoms and an alkanol tertiary monoamine.

10. The composition according to claim 9, wherein said carboxylic solubilizer is obtained as the reaction product of polybutenyl succinic anhydride with N,N-diethylethanol amine.

11. The composition according to claim 10, wherein the molar ratio of anhydride to amine is about 1:1.

12. The composition according to claim 1, wherein said composition further comprises a sulfurized compound selected from the group consisting of:

(a) sulfurized olefins;

(b) sulfurized fatty acids;

(c) sulfurized fatty acid esters of polyhydric alcohols;

and mixtures thereof.

13. The composition according to claim 12, wherein said sulfuvized compound is sulfurized isobutene.

14. The composition of claim 1, wherein said oil is selected from the group consisting of animal, plant, mineral or synthetic oils and/or mixtures thereof.

15. A composition according to claim 1, wherein said composition further comprises a viscosity modifier selected from the group consisting of:

(A) polymethacrylates;

(B) polyolefins;

(C) Malan styrene copolymers;

and mixtures thereof.

16. A composition according to claim 1 when said composition further comprises a pour point depressant.

17. A functional composition having improved low temperature and antiwear properties, said composition comprising:

A. A major amount of oil of lubricating viscosity;

B. A minor amount of an additive package, said package comprising:

(1) an alkali or alkaline earth metal salt complex, said complex selected from the group consisting of:

(a) a borated metal salt complex;

(b) a mixture of borated and non-borated metal salt complexes wherein said complex has a TBN of up to 800 on an oil free basis;

(2) an EP/antiwear agent in the form of a mixture of zinc salts of a dialkylphosphorodithioic and alkyl carboxylic acids treated with triaryl phosphite or an olefin to reduce free sulfur;

(3) a borated epoxide;

(4) a carboxylic solubilizer in the form of an ester salt reaction product of an acylating agent containing a substituted hydrocarbyl-based substituent containing about 12 to about 500 carbon atoms and an alkanol tertiary monoamine;

(5) a sulfurized compound, said sulfurized compound selected from the group consisting of:

(a) sulfurized olefins;

(b) sulfurized fatty acids;

(c) sulfurized fatty acid esters of polyhydric alcohols;

and mixtures thereof; wherein said composition has a 100° C. kinematic viscosity of at least 4cSt, a −40° C. Brookfield viscosity maximum of 20,000 cP, and wherein said composition passes the JDQ95 Spiral Bevel Gear Test.

18. A composition according to claim 17, wherein said metal is calcium.

19. A composition according to claim 17, wherein said salt complexes have a TBN of up to 800.

20. A compound according to claim 17, wherein said carboxylic solubilizer is obtained as the reaction product of polybutenyl succinic anhydride with N,N-diethylethanol amine.

21. A compound according to claim 17, wherein said sulfurized compound is sulfurized isobutene.

22. A composition according to claim 20, wherein the molar ratio of anhydride to amine is about 1:1.

23. The composition according to claim 17, wherein the weight ratio of borated to non-borated metal salts in said mixture of salts is 0.1:3 to 1:0.05.

24. The composition according to claim 17, wherein the boron content of said borated metal salt is about 1–10 weight percent based on the weight of said salt.

25. The composition according to claim 17, wherein said zinc salts are a mixture of bis-(2-ethylhexyl)-dithiophosphate and 2-ethyl-hexanoic acid zinc salts.

26. The composition according to claim 17, wherein said borated epoxide is the reaction product of boric acid with a 1,2 epoxide containing about 16 carbon atoms.

27. A composition according to claim 15, wherein said composition further comprises a viscosity modifier selected from the group consisting of:

(A) polymethacrylates (B) polyolefins (C) Malan styrene copolymers.

28. A composition according to claim 17, wherein said oil of lubricating viscosity is selected from the group consisting of animal, plant, mineral or synthetic oils and/or mixtures thereof.

* * * * *